United States Patent [19]

Megerle

[11] 4,389,041

[45] Jun. 21, 1983

[54] PYROMETALLURGICAL FURNACE SYSTEM WITH READILY REMOVABLE WALL SECTIONS

[75] Inventor: Friedrich Megerle, Cologne, Fed. Rep. of Germany

[73] Assignee: Klöckner-Humboldt-Deutz AG, Fed. Rep. of Germany

[21] Appl. No.: 426,619

[22] Filed: Sep. 29, 1982

[30] Foreign Application Priority Data

Oct. 2, 1981 [DE] Fed. Rep. of Germany ..... 3139278

[51] Int. Cl.[3] ..... C21B 7/10

[52] U.S. Cl. ..... 266/194; 266/241

[58] Field of Search ..... 266/194; 266/241

[56] References Cited

U.S. PATENT DOCUMENTS 4,358,094 11/1982 Mergerle et al. ..... 266/194

*Primary Examiner*—M. J. Andrews

*Attorney, Agent, or Firm*—Hill, Van Santen, Steadman, Chiara & Simpson

[57] ABSTRACT

The present invention deals with an improved pyrometallurgical furnace system of the type in which the melt and/or slag comes into contact with cooled furnace walls. The improvements of the present invention are directed to mechanical structures in which the cooling elements are sectionalized and are releasably secured to cooling element carriers, with pivotal means being provided to enable the cooling element carriers to be pivoted into position providing access to the cooling elements which are releasably secured to the carriers.

10 Claims, 6 Drawing Figures

14
13
15
16
57
56
II
17
18
12
11
10
23
24
25
27
28
29
20
19
21
22
26
49
41
45
II

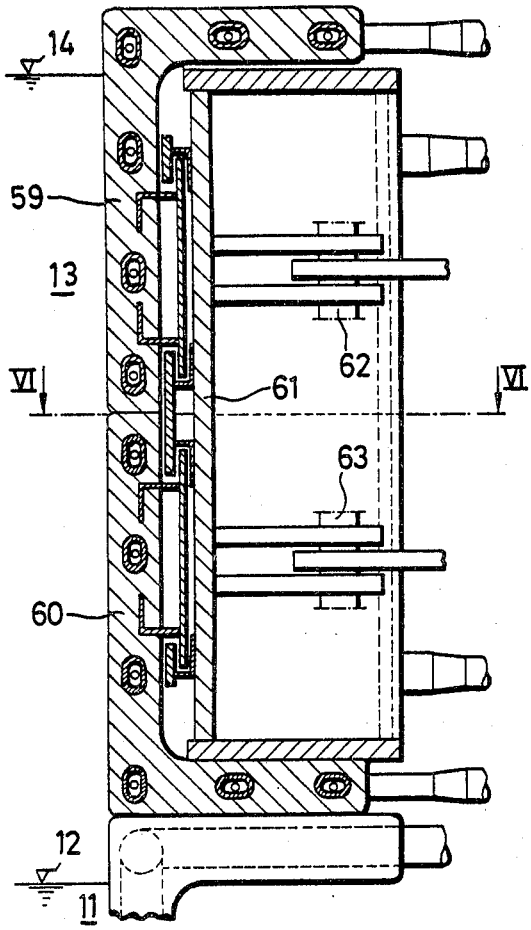
FIG.5
FIG.6
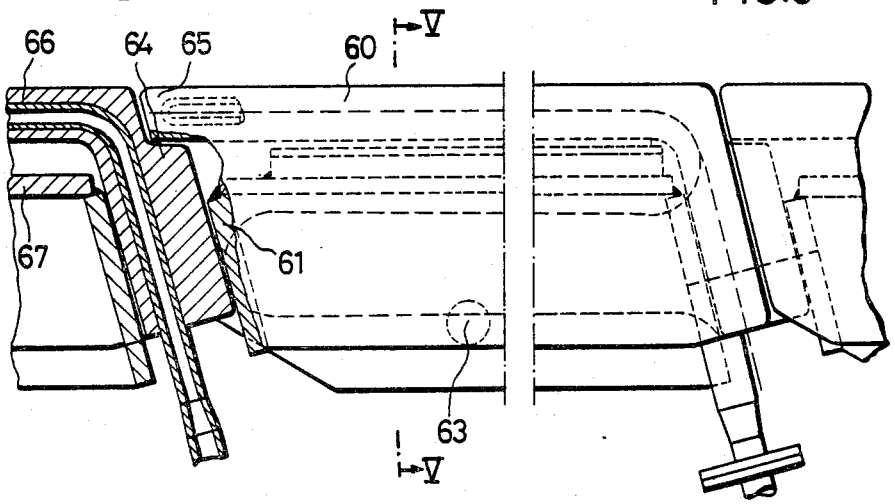

PYROMETALLURGICAL FURNACE SYSTEM WITH READILY REMOVABLE WALL SECTIONS

BACKGROUND OF THE INVENTION

1. Field of the Invention

The present invention is in the field of pyrometallurgical furnaces, particularly for melting ore concentrates and for the aftertreatment of the melts, and is concerned with a sectionalized system of furnace walls in which the individual sections are readily removable for replacement.

2. Description of the prior Art

In previously described pyrometallurgical furnace systems such as those for melting fine-grained, sulfidic lead ore concentrates, and shown in German OS No. 29 35 394, FIGS. 4 and 5, the furnace walls in the area which comes into contact with the molten materials are composed of individual water boxes composed, for example, of copper and containing cooling channels in which cooling water is circulated. Due to the large cooling effect, a thin layer of slag freezes onto the inner surface of the water box and protects the same from corrosion due to the hot, corrosive slag bath. As a result of their size, the water boxes which extend over the entire height of the slag bath are relatively heavy and cumbersome. Replacement of the individual water boxes is only possible with a cold furnace because with a hot furnace the immediately adjacent water boxes which are rigidly clamped at their outside seize as a result of their thermal expansion. Even if the abutting surfaces of the horizontally adjacent water boxes were to be shaped conically, it would only be each second water box which would be directly detachable without the adjacent water boxes having to be previously detached.

SUMMARY OF THE INVENTION

The present invention provides a furnace system having furnace walls whose water boxes or cooling elements come into contact with the molten slag and can be readily attached and detached so that they can be individually replaced immediately after tapping the slag with a hot furnace when repairs are required. Consequently, only short operating interruptions of the furnace system occur.

In the improved furnace system of the present invention, the cooling means which come into contact with the slag consist of horizontally disposed, plate-shaped cooling elements which are provided with cooling channels and are arranged one above the other. Such cooling elements preferably consist of copper or other highly heat conductive metal. A plurality of such cooling elements are arranged one above the other and are releasably secured to a common, door-like cooling element carrier preferably consisting of sheet steel or the like. The door-like cooling element carriers can be pivoted from the cooling wall by means of joints or hinges which in turn are supported to supporting elements at the outside of a stationary supporting structure. The comparatively lightweight cooling elements are easily manipulated during assembly and disassembly. When repair is required, the slag situated in the furnace is tapped, the support elements between the door-like cooling element carriers and the stationary support structure are removed, and the cooling element carriers can then be pivoted out of the furnace wall toward the outside and the individual cooling elements released.

Typically, the cooling elements can be releasably secured to the cooling element carriers by means of a slide connection which can be quickly replaced and can even be interchanged because the individual cooling elements are of the same size. Operating interruptions resulting from repair work on the cooling elements are thus reduced to a minimum.

With the improvements of the present invention, a clear separation is achieved between the cooling elements which have the cooling function and the carrying and support elements which support the same. The cooling water connecting lines of the plate-shaped cooling elements project out of the furnace wall toward the outside between the horizontally adjacent, door-like cooling element carriers. Because of the close sliding fit between the door-like cooling element carriers and the individual, plate-shaped cooling elements secured thereto, the latter are free to move as required by thermal expansion. The door-like cooling element carriers which are supported on the stationary support structure can likewise take part in thermal expansion. Overall, the structure of the present invention is characterized by a high ratio between the effective furnace wall cooling surfaces and the weight of the cooling elements while providing a very rapid accessibility to the inside of the furnace.

BRIEF DESCRIPTION OF THE DRAWINGS

Other features and advantages of the present invention are explained in greater detail on the basis of the embodiments shown in the drawings in which:

FIG. 5 is a view similar to FIG. 1 but illustrating a modified form of the present invention, the view being taken substantially along the line V—V of FIG. 6; and FIG. 6 is a cross-sectional view taken substantially along the line VI—VI of FIG. 5.

DESCRIPTION OF THE PREFERRED EMBODIMENTS

Figure 1:
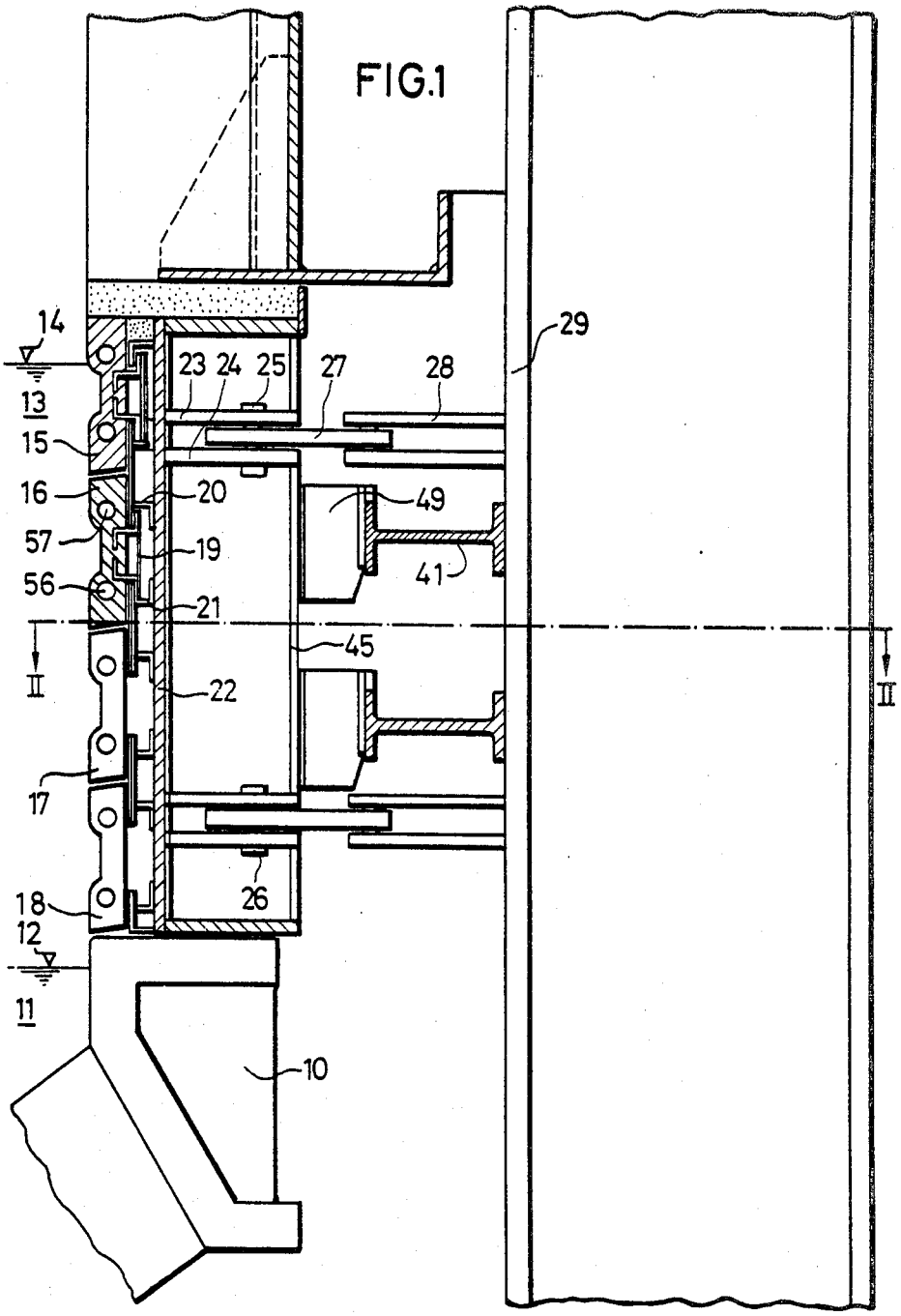
FIG. 1 is a vertical sectional view of an improved pyrometallurgical furnace system according to the present invention, taken along the line I—I of FIG. 2.

The pyrometallurgical furnace system shown in the drawings can be used, for example, for melting fine-grained, sulfidic lead ore concentrates. The drawings illustrate a melt 11 of lead having a molten lead surface 12 which collects in a furnace trough 10 supported from below over a suitable foundation. Situated above the bath is a slag bath 13 having a molten slag surface 14. The portion of the furnace wall coming into contact with the slag 13 is protected by individual plate-shaped cooling elements 15, 16, 17 and 18 horizontally arranged one above the other and preferably consisting of copper. Means are provided for circulating cooling water through each of the cooling elements 15 through 18. As a result of the strong cooling effect, a thin slag layer freezes onto the surface of the cooling elements 15 through 18, the slag layer protecting the surface of the cooling elements against corrosion due to the molten slag.

As clearly shown in FIG. 1, support elements 19 project from the backs of the cooling elements 15 through 18, the cooling elements being inserted into horizontal rails 20, 21 by means of the support elements 19, the rails 20 projecting from the front side of a cooling element carrier 22 which consists of a sheet steel housing or the like which is open toward the outside. Upper and lower hinged joints 25, 26 are disposed in the cooling element carrier 22 between arms 23, 24 whereby the hinged joints 25, 26 are secured to a vertical carrier 29 through additional hinge means 27, 28. In order to relieve the stresses on the joints and hinges, the underside of the cooling element carrier 22 is supported against the furnace trough 10 in the operating condition.

In the sample embodiment shown in FIG. 1, four plate-shaped cooling elements 15 through 18 are horizontally disposed above each other and are releasably secured to the common cooling element carrier 22 by the sliding engagement previously described. Three such horizontally adjacent cooling element carriers 22, 30 and 31 can be seen in FIG. 2, each of which carries four plate-shaped cooling elements. The cooling element carrier 30 includes a hinged joint 32 and the cooling element carrier 31 has a hinged joint 33 whereby each cooling element carrier can be pivoted out of the furnace wall in door-like fashion toward the outside of the furnace in the direction of the arrow 34 by means of the respective joints. This condition is illustrated in FIG. 2 wherein the cooling element carrier 31 carrying plate-shaped cooling element 35 through which cooling water is flowing has just been pulled out for replacement in the direction of the arrow 36, with the lower cooling element 37 still being in its inserted operating position.

Figure 2:
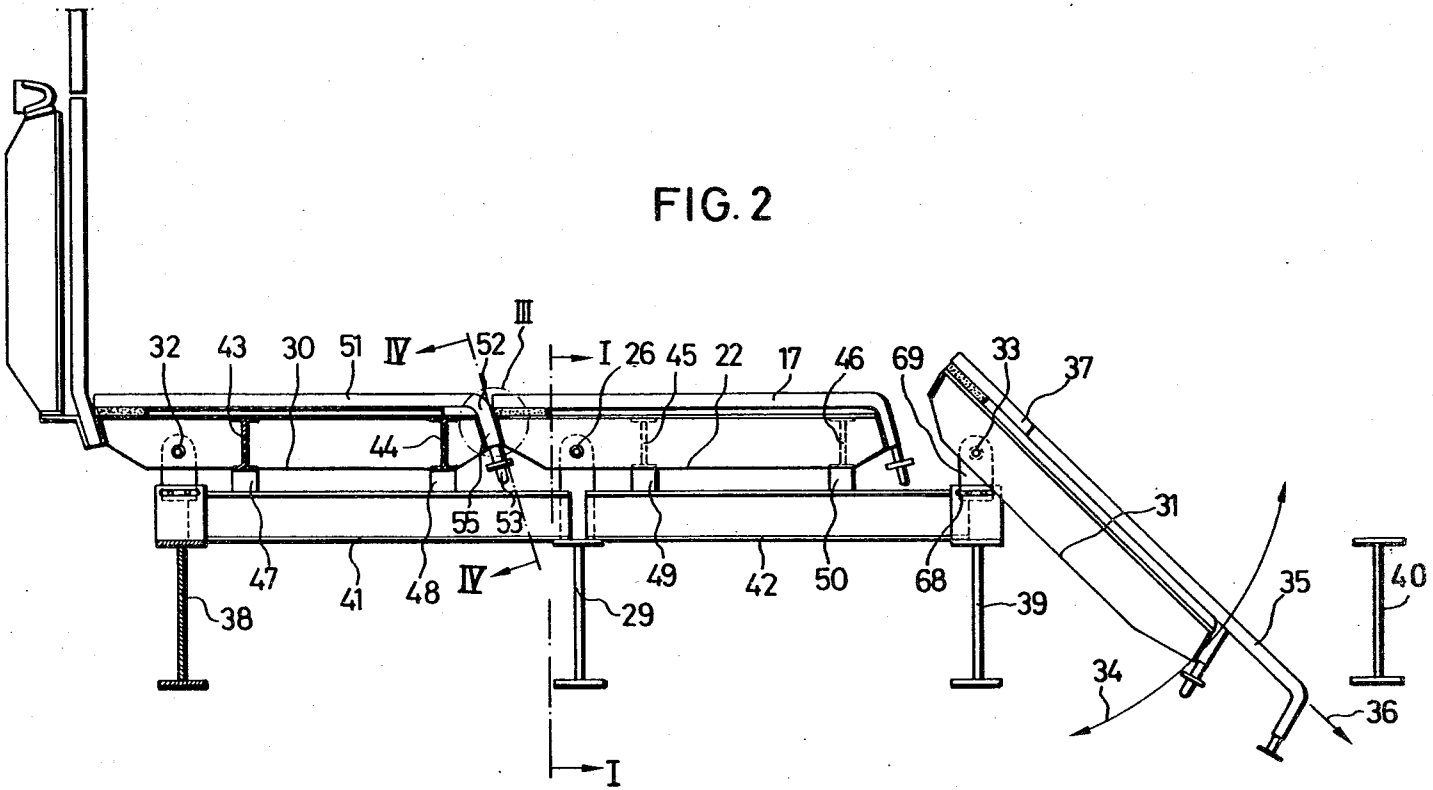
FIG. 2 is a horizontal cross-sectional view through the furnace system taken substantially along the line II—II of FIG. 1.

As seen in FIG. 2, the stationary support structure includes vertical carrier beams 29, 38, 39 and 40 spaced by a distance, for example, of 2.40 meters which corresponds to the spacing of the joints 26, 32, 33 of adjacent cooling element carriers 22, 30, 31 and which also approximately corresponds to their horizontal length. The vertical carrier beams 29, 38, 39 are connected to each other by means of horizontal beams 41 and 42. Wedges 47 through 50 are insertable between the horizontal carriers 41, 42 and inside stiffening ribs 43 through 46 attached to the cooling element carriers 22, 30 so that the cooling element carriers despite their pivotal capability are securely supported in the operating condition. With the length of each plate-shaped cooling element being about 2.40 meters, the height of all four cooling elements disposed above one another may amount, for example, to approximately 1.30 meters. The hinged pivot points of the individual cooling element carriers preferably are in proximity to one end of the carriers.

Figure 3:
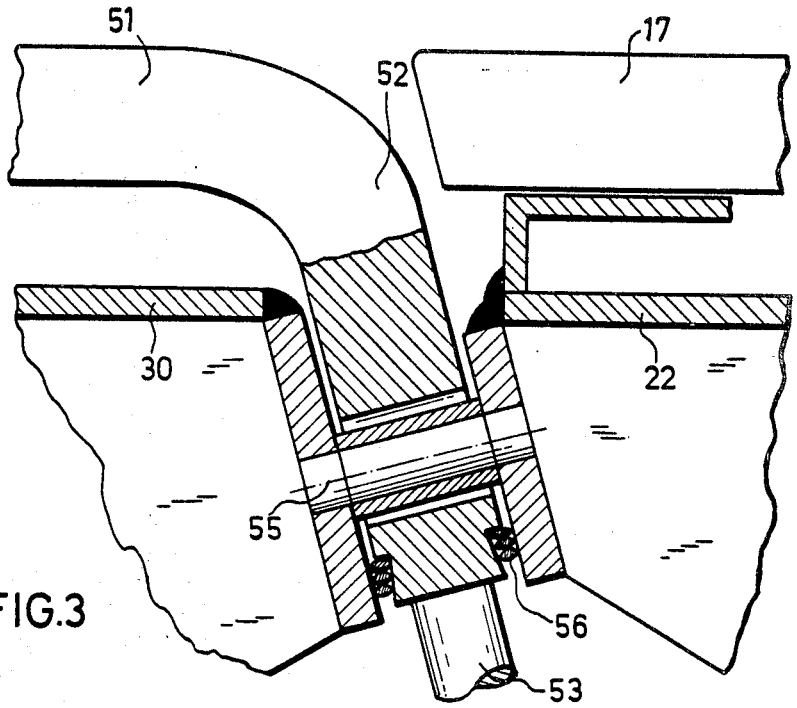
FIG. 3 is an enlarged illustration of the detail identified at III in FIG. 2.

As seen in FIGS. 2 and 3, the horizontally adjacent cooling element carriers 30, 22 have a spacing gap therebetween through which a cooling element 51 secured to the cooling element carrier 30 is directed toward the outside with its longitudinal end 52 being bent toward the outside at one side wall as well as being provided with cooling water intake and discharge lines 53 and 54. The adjacent cooling element carriers 30, 22 are connected to each other in the area of the spacing gap by means of a clamping device 55 such as a screw bolt. As shown in FIG. 3, the spacing gap is sealed by means of packing glands 56 consisting, for example, of asbestos which when starting up the furnace system provides a gas-tight seal of the inside space of the furnace.

Figure 4:
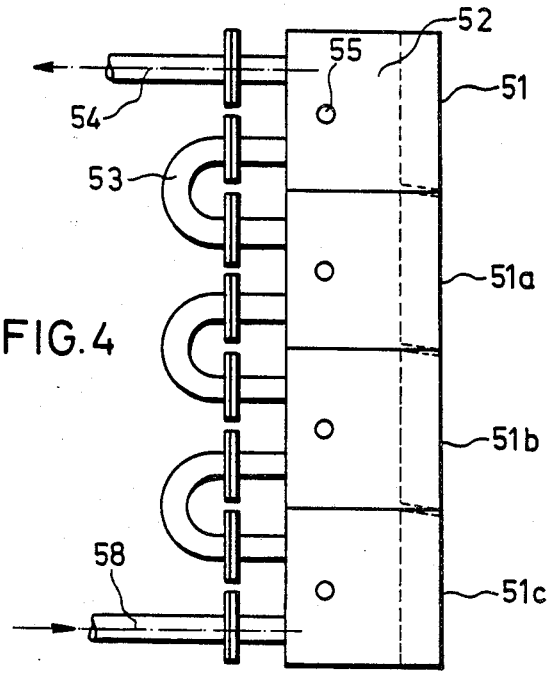
FIG. 4 is a cross-sectional view taken substantially along the line IV—IV of FIG. 2.

As seen in FIG. 1, the plate-shaped cooling elements preferably consist of copper having a cooling water inlet 56 and a cooling water outlet channel 57 connected thereto and lying thereabove. It can be seen from FIG. 4 that the lowest cooling element 51*c* of the four cooling elements 51, 51*a*, 51*b* and 51*c* is connected to a cooling water intake line 58 and the uppermost cooling element 51 is connected to a cooling water discharge line 54 and that the cooling water channels of the adjacent cooling elements are connected to one another by means of U-shaped pipe bends 53.

In the embodiment shown in FIG. 5, the cooling elements 59, 60 preferably consisting of copper have an angular shape in vertical section so that their edges enclose the upper and lower surfaces of the cooling element carriers 61. The pivotal joints 62, 63 may be composed of sheet steel.

With the type of structure shown in FIGS. 5 and 6, the transition of the furnace wall area from the lower cooling element 60 up to the furnace trough 10 is well protected because as a result of the large cooling contact surface, a frozen protective slag layer is formed at the inside wall of the furnace as well as at any inside wall gaps which may exist during operation of the furnace system. Overlapping portions 64, 65 of mutually adjacent cooling elements 66, 60 in the area of the spacing gap between mutually adjacent cooling element carriers 67, 61 are also provided.

Thermal expansion in the furnace wall is absorbed by the close sliding fit between the cooling elements and the carriers as well as, according to FIG. 2, the bearing 68 of the hinges 69 which can be displaced in the horizontal direction and which carry the joint 33 of the respective cooling element carrier 31. A similar sliding capability is provided at the opposite end of the horizontal carrier beam 41.

In the case of repair being necessary to one or more of the cooling elements in the furnace system, the slag 13 is first run off. Then the clamping means 55 or one of the other clamping means is released. After the wedge pieces 49, 50, as well as the horizontal carriers 42 at the neighboring location have been dismantled, the respective cooling element carriers after detaching the cooling water intake and discharge conduits, can simply be pivoted out of the furnace wall toward the outside in the direction of the arrow 34. Consequently, this change can be made while the furnace is still hot. Then the damaged cooling element such as element 35 is simply withdrawn and is replaced by a new cooling element so that the replaced element can be repaired at leisure. In the reverse sequence, the furnace is once again closed and placed in operation. Operating interruptions of the furnace system caused by repair to the cooling elements are thus reduced to a minimum.

It should be evident that various modifications can be made to the described embodiments without departing from the scope of the present invention.

I claim as my invention:

1. In a pyrometallurgical furnace system including furnace walls in which at least the areas of such walls which come in contact with molten metal are provided with cooling elements through which a coolant circulates, the improvement which comprises:

at least one cooling element carrier, a plurality of adjacent cooling elements each releasably secured to said cooling element carrier, support means fixedly secured with respect to said furnace, and pivotal means interconnecting said support means with said cooling element carrier permitting the same to be pivoted into a position providing access to the cooling elements releasably secured to said cooling element carrier.

2. A furnace system as claimed in claim 1 in which:

said adjacent cooling elements are arranged in vertical superimposed relation, and each cooling element is composed of a highly heat conductive material.

3. A furnace system as claimed in claim 1 which includes:

groove means in said cooling element carrier, and retainer means positioned at the rear ends of said cooling elements arranged to be received in sliding relation within said groove means.

4. A furnace system as claimed in claim 1 in which:

said pivotal means includes a pair of joints in spaced relation along said cooling element carrier, and a pair of hinges interconnecting said pair of joints with said support means.

5. A furnace system as claimed in claim 4 which includes:

a plurality of cooling element carriers, vertical beams in said support means spaced from one another by a spacing corresponding to the spacing of said pivotal means of adjoining cooling element carriers, horizontal beams interconnecting said vertical beams, and wedge means disposed between said horizontal beams and said cooling element carriers.

6. A furnace system as claimed in claim 1 which includes:

a plurality of cooling element carriers, each cooling element carrier being spaced from a horizontally adjacent cooling element carrier by a spacing gap, cooling conduits extending into each of said cooling elements, and clamping means connecting together said cooling element carriers in the vicinity of said spacing gaps.

7. A furnace system according to claim 6 in which:

said cooling conduits are arranged in superimposed vertical relation on each of said cooling elements.

8. A furnace system according to claim 7 in which:

all of said cooling elements are of the same size and therefore interchangeable.

9. A furnace system according to claim 6 in which:

said horizontally adjacent cooling element carriers have overlapping portions in the area of said spacing gap.

10. A furnace system according to claim 1 in which:

said cooling elements have angular edges which enclose the upper and lower surfaces of said cooling element carriers.

* * * * *